US005604526A

United States Patent [19]

Kwak

[11] Patent Number: 5,604,526

[45] Date of Patent: Feb. 18, 1997

[54] CORRECTION APPARATUS FOR THERMAL PRINTER

[75] Inventor: Hee-gook Kwak, Suwon, Rep. of Korea

[73] Assignee: Samsung Electronics Co., Ltd., Kyungki-do, Rep. of Korea

[21] Appl. No.: 181,050

[22] Filed: Jan. 14, 1994

[30] Foreign Application Priority Data

Jan. 14, 1993 [KR] Rep. of Korea ..... 93-416
Jan. 3, 1994 [KR] Rep. of Korea ..... 94-15

[51] Int. Cl.[6] ..... B41J 2/36; B41J 2/365; B41J 2/37

[52] U.S. Cl. ..... 347/191; 347/184

[58] Field of Search ..... 347/183, 191, 347/184; 400/120.11, 120.07

[56] References Cited

U.S. PATENT DOCUMENTS 4,540,991 9/1985 Kariya et al. ..... 347/191
4,801,948 1/1989 Kato ..... 347/191
5,153,605 10/1992 Ohara et al. ..... 347/191

*Primary Examiner*—Huan H. Tran
*Attorney, Agent, or Firm*—Sughrue, Mion, Zinn, Macpeak & Seas

[57] ABSTRACT

A correction apparatus for a thermal printer includes a memory for storing the deviation quantity of each heating element of a thermal print head or a temperature correction quantity, a first computer means for adding introduced image data and the deviation quantity wherein the gradation value of the image data is reflected when the heating element for printing the introduced image data is lower than the average resistance value or the current temperature, a second computer means for subtracting the deviation quantity wherein the gradation value of image data is reflected, from the introduced image data when the heating element for printing the introduced image data is higher than the average resistance value or the current temperature. Thus, the resistance correction according to the deviation of the heating element resistance and the temperature correction are realized by a simple circuit, thus reducing the memory capacity, which decreases the amount of required hardware.

3 Claims, 6 Drawing Sheets

CORRECTION APPARATUS FOR THERMAL PRINTER

BACKGROUND OF THE INVENTION

The present invention relates to a correction apparatus for a thermal printer, and more particularly, to a correction apparatus for a thermal printer which performs corrections in accordance with the resistance deviation of a heating element, and performs temperature and color corrections, wherein the correction apparatus uses simple hardware construction.

Generally, the sublimation type thermal printer prints using a thermal print head (TPH). Such a printer prints the desired image by using the energy emitted by the TPH to sublimate dye deposited on a film and thereby deposit the dye on recording paper.

The block diagram of the general thermal printer is shown in FIG. 1. An analog-to-digital (A/D) converter 10 inputs the analog image signal transmitted from a signal input source, for example, a video camera or television, as red (R), green (G) and blue (B) signals which are then converted into digital signal form.

A first selector 20 selects a signal output from A/D converter 10 or from digital image data transmitted through such protocols as GP-IB, SCSI or Centronics, by digital signal input sources such as a personal computer or graphics display computer.

The image signal selected by first selector 20 is stored in screen memory 30 by screen units of frames or fields under the control of memory controller 40 which controls data read/write timing.

A second selector 50 constituted by multiplexers selects one signal among the R, G and B data stored in screen memory 30, and a color converter 60 converts the selected signal into the complementary color signal, i.e., the B signal is converted into a yellow (Y) signal, the G signal is converted into a magenta (M) signal, and the R signal is converted into a cyan (C) signal.

Additionally, a corrector 70 performs gamma correction, color correction, resistance correction and temperature correction on the output of color converter 60, which is then written in a line memory 80 by line units.

The data read out from line memory 80 by line units is compared in terms of its gradation levels using a predetermined gradation value from a middle gradation converter 90. Then a strobe signal corresponding to the heating time is generated in the units of the compared gradation. TPH 100 is driven during the heating time interval, thereby performing a color printing operation.

The color printing is performed by printing the three colors Y, M and C respectively on one recording paper according to the following process.

When the data is read from screen memory 30, a vertical line of data is read by a second selector 50 for an initial B signal, and is then written into line memory 80 through color converter 60 as a Y signal. The data written into line memory 80 is modified by a middle gradation conversion in middle gradation converter 90, and then is transmitted to TPH 100, to thereby complete the printing of one line. Thus, when approximately 500–600 lines are printed for one screen, the printing of one color (the Y color which is the complement of B color) is completed.

Second selector 50 transfers data corresponding to one screen of the G signal from screen memory 30 to line memory 80 by vertical lines. Next, the printing of one screen of the M color (the complement of G color) is completed through the above-described process. Then the R signal for one screen is selected by second selector 50 and read from line memory 80 by vertical lines in the same manner. Then the printing of the C color (the complement of R color) is completed through the above process.

In FIG. 1, A/D converter 10 to memory controller 40 make up image signal processing circuit 1, and second selector 50 to TPH 100 make up print control circuit 2. Also provided in the present invention is an image display circuit (not shown) for processing the output of image signal processing circuit 1 for display on a display device, e.g., a monitor.

FIG. 2 is a detailed circuit diagram of the middle gradation converter shown in FIG. 1. Referring to FIG. 2, when the data of one vertical line is written into line memory 80, a gradation level generator 92 is enabled by an address generator 91, and the read address is output so that line memory 80 can perform a reading operation.

Gradation level generator 92 outputs data for a first gradation level, i.e., "0000 0001", to an erasable programmable ROM (EPROM) 93 and to a gradation comparator 96. Assume that first gradation level (i.e., an optical density expressed as "0000 0001") is 0.2. In order to apply energy E1 to the printing film, as shown in FIG. 3, the strobe signal for the duration of electrification time t1 which corresponds to energy E1 is generated from a time interval generator 95 and is applied to a latch register 102. Thus, heating elements 103 emit heat for expressing the first gradation level.

Accordingly, heat energy corresponding to a gradation level of an optical density is emitted in proportion to the optical density, as shown in S-shaped curve of FIG. 3, and heating time becomes longer as the optical density increases, as shown in FIG. 4.

In the heating of second gradation level, gradation level generator 92 outputs "0000 0010," and gradation comparator 96 compares the image data of line memory 80 which is input to first input terminal A with the gradation data input to second input terminal B. The operation is performed 256 times, .i.e., once for each gradation (0–255), whereby a logic "high" is output when the image data of line memory 80 is higher than the gradation data of gradation level generator 92, and when lower, a logic "low" is output. Then, the output data of gradation comparator 96 is sequentially delivered to shift register 101. For example, approximately 512 data bits are shifted and stored for the thermal printer which prints on A6 size recording paper. This example assumes a case where 512 TPH heating elements (103 of FIG. 2) are needed for printing one line of A6 size paper.

In EPROM 93, the heating time is preprogrammed corresponding to the gradation data generated from gradation level generator 92, and a strobe signal is generated for each gradation from a time interval generator 95 which corresponds to the time constant determined by the capacitance of capacitor C1 and the resistance value of one of resistors (rl–rm) selected by driving electronic switch 94. The generated strobe signal is also applied to latch register 102.

The output of shift register 101 is delivered to latch register 102, to thereby cause the heating of heating elements 103 during the time interval t2 generated from time interval generator 95.

Thus, when the heating is completed according to the above-described process for the 255th gradation, printing for one line is completed. In like manner, heating for 500–600 lines in one screen of a video printer for use with A6 size paper is performed. Heating for the three complimentary colors Y, M and C is performed the same as in the above process, thereby performing a color printing.

Meanwhile, a color correction for the YMC dam, a temperature correction for the heating element by each gradation, and a resistance correction according to the deviation of the resistive heating elements are all performed in corrector 70. Ideally, the resistance correction should be based on the same resistance values for each heating element, but generally speaking each resistance has a variation depending on specific production conditions.

Here, energy (E) can be expressed according to the following equation (1).

$$E=\left(\frac{V^2}{R}\right)T \tag{1}$$

To illustrate how varying resistances affect image quality, assume that 525 heating elements are required for printing one line and the reference resistance value (the average resistance value) thereof is 3 K, and that the heating time (T) and the applied voltage (V) are fixed. When the resistance value is larger than 3 K due to the deviation of each resistance value of heating elements 103, the heating energy decreases, as shown in Equation (1). As a result, the image quality is degraded in the main scanning direction as shown in FIG. 5, by the generation of a dim trace in the horizontal direction.

Accordingly, since the energy emitted by each resistance differs from that of the others, the same density cannot be obtained even though the electrification is performed for the same duration so as to obtain images having the same density. Therefore, the desired color of an image is difficult to achieve.

To solve this problem, a TPH manufacturer estimates each resistance of the thermal print head and provides this information to the various hardware manufacturers of image processors, print controllers and image displays for driving a TPH. The hardware manufacturer then changes the estimated data, such that corrector 70 can correct for the deviation of each resistance.

Corrector 70, as shown in FIG. 6, functions as follows: Uncorrected m-bit image data generated from color converter 60 is input as the address signal of the lower m-bits of a second ROM 72. In a first ROM 71, the resistance location address of k-bits of TPH 100 corresponding to the heating element to which the current image data is being applied is input from address generator 91 of middle gradation converter 90. Then first ROM 71 outputs n-bits which represent a stored quantized value corresponding to the degree of deviation between the resistance value of the input address and the reference value (an average resistance value). Then the output data of first ROM 71 is input as the address signal of the upper n-bits of second ROM 72.

Here, each resistance location address bit corresponds to a power of two, e.g., when the number of resistive elements of TPH 100 is 512, "k" consists of nine bits, because 512 is two to the ninth power. In the same manner, if the number of elements is 2048 ($2^{11}$), the resistance location address signal k consists of eleven bits. The bit number of k is larger than that of n.

When the total number of resistances is 2048, k is 11 bits since k-bits is a resistance location address of TPH 100. The capacity of second ROM 72 can be greatly extended by reducing the k-bit data to n-bit data by using first ROM 71.

This can be understood by considering that the maximum number of gradation levels which can be expressed by m-bit image data is $2^m$. Therefore, the memory capacity required for each resistor of TPH 100 is $2^m$. Accordingly, to store all the data, a large capacity ($2^m$×2048) is needed for the total of 2048 resistances. Since the m-bit image data consists of eight bits, about 1 M bytes of memory capacity is needed.

In first ROM 71, since the amount of resistance deviation between an arbitrary resistance and the adjacent resistance in TPH which consists of a plurality of resistances is small, 11-bit data can be converted into 6 bits by grouping several adjacent elements. Then the output (6-bits data) of first ROM 71 can be input to the address of second ROM 72. Accordingly, the capacity of second ROM 72 can be decreased using first ROM 71.

In second ROM 72, a more desirable thermal print head can be obtained as the variation of the resistance value of TPH becomes smaller. This is impractical, however, due to semiconductor manufacturing process limitations. With the allowable value of the maximum variance fixed as "111111" in binary form, a 6-bit signal is output whose most significant bit (MSB) is a sign bit.

When the MSB is "1," the relevant resistance value is larger than the average resistance value. Therefore, the address of second ROM 72, wherein the data whose gradation is lower than that of the currently input data is stored, is accessed. If the MSB is "0," the relevant resistance value is smaller than the average resistance value. Therefore, accessing of second ROM 72 is carried out for the data whose gradation is higher than that of the currently input image data. Here, 256 eight-bit data strings constitute one block, and second ROM 72 is composed of 64 blocks in total.

To explain this in more detail, assume a first element of TPH resistance is 3.4 K and the average resistance value of TPH is 3.5 K, and the resistance location address is input to first ROM 71 as "00000000001." Then, 6-bit data of "100011" is stored into the corresponding resistance location address of first ROM 71 so as to print using a gradation level which is three levels lower than average, since energy E increases when the resistance R decreases according to Equation (1).

Further, when the data is input to the upper bit address of second ROM 72, the substantial compensative data whose gradation is lower by three gradations than that of the image data output from color converter 60 is output.

When these two ROMs (71 and 72) are used, 2,048 ($2^{11}$) bytes are required for the capacity of first ROM 71 and 16 K bytes (64×256) are required for the capacity of second ROM 72 if TPH has 2048 heating elements. As a result, memory capacity is decreased.

The quantity of hardware decreases as the capacity of the memory decreases, thereby reducing the cost.

SUMMARY OF THE INVENTION

Accordingly, it is an object of the present invention to provide a correction apparatus for a thermal printer which realizes temperature, color, and resistance corrections using simple hardware construction in a sublimation type thermal printer.

To accomplish the above object, there is provided a thermal printer which introduces an image signal from a signal input source and performs a gradation comparison with respect to a predetermined gradation value by line units, and then performs printing using a thermal print head consisting of a plurality of heating elements, the printer comprising:

a line memory for storing the image signal by line units;

correction means having a memory wherein the deviation information of each heating element of the thermal print head is stored, and computing means for adding the image data of the line memory to the amount of deviation wherein the gradation value of the image data is reflected, by reading the deviation information stored in the memory when the resistance value of a heating element used for printing image data read from the line memory is lower than average resistance value, and for subtracting the amount of deviation wherein the gradation value of the image data is reflected, from the image data of the line memory by reading the deviation information stored in the memory when the resistance value of heating element for printing image data read from the line memory is higher than average resistance value; and TPH control means for performing a gradation comparison between the output of the correction means and the predetermined gradation value, and outputting the result to the thermal print head.

In another embodiment of the present invention, there is provided a thermal printer which introduces an image signal from a signal input source and performs a gradation comparison with a predetermined gradation value by line units, and then performs printing using a thermal print head consisting of a plurality of heating elements, the printer comprising:

a line memory for storing the data of the image signal by line units;

detecting means for detecting the temperature of the current thermal print head;

correction means having a memory wherein the correction information corresponding to the difference between the temperature of the current thermal print head and a predetermined reference temperature is stored, and computing means for summing the image data read from the line memory and the amount of correction wherein the gradation value of the image data is reflected, by reading the correction information stored in the memory when the detected temperature of the current thermal head is lower than the predetermined reference temperature, and for subtracting the amount of correction wherein the gradation value of the image data is reflected, from the image data of the line memory, by reading the correction information stored in the memory when the detected temperature of the current thermal print head is higher than the predetermined reference temperature; and TPH control means for performing a gradation comparison between the output of the correction means and the predetermined gradation value, and outputting the result to the thermal print head.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE INVENTION

The present invention will be described below in more detail with reference to the attached drawings.

Figure 1:
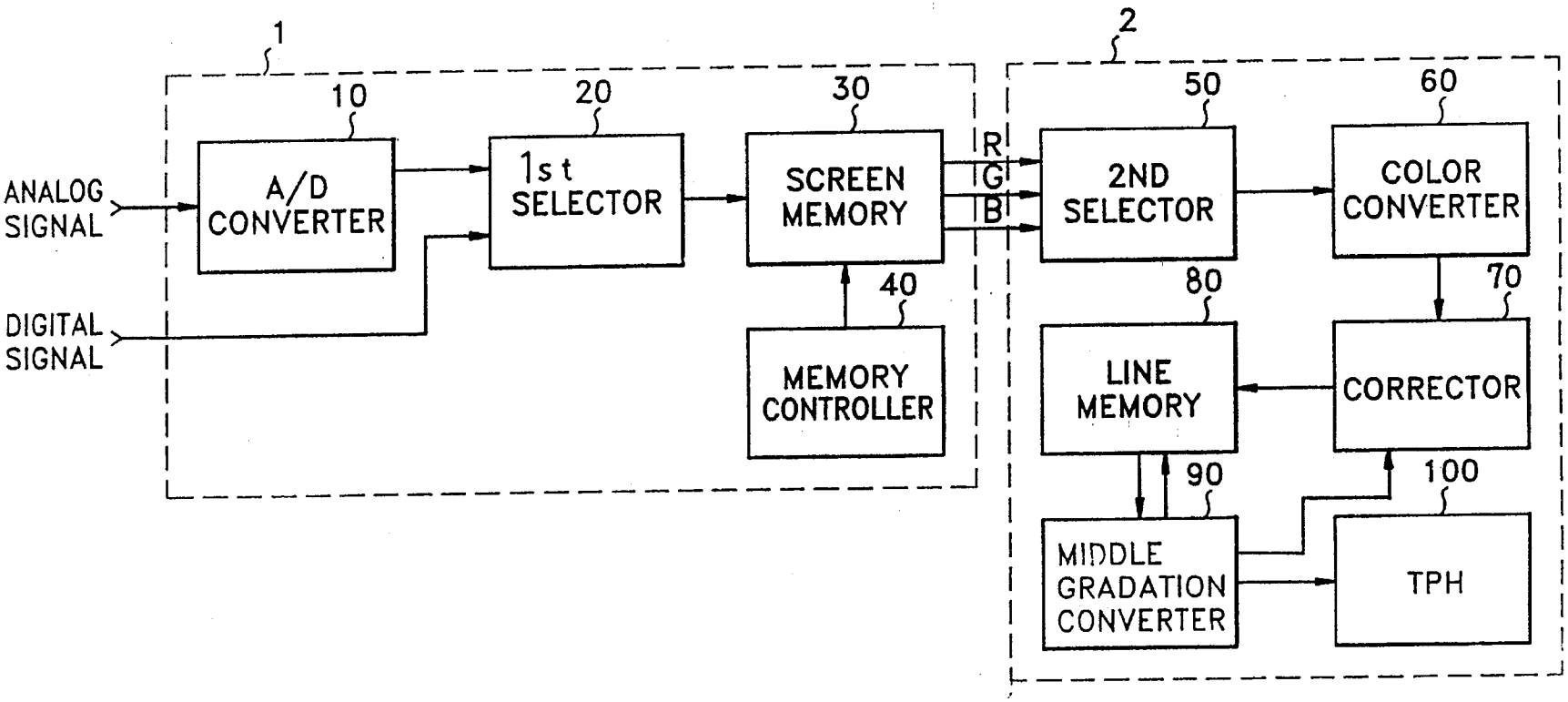
FIG. 1 is a block diagram showing a general thermal printer to which the prior art and the present invention can be applied.
Figure 2:
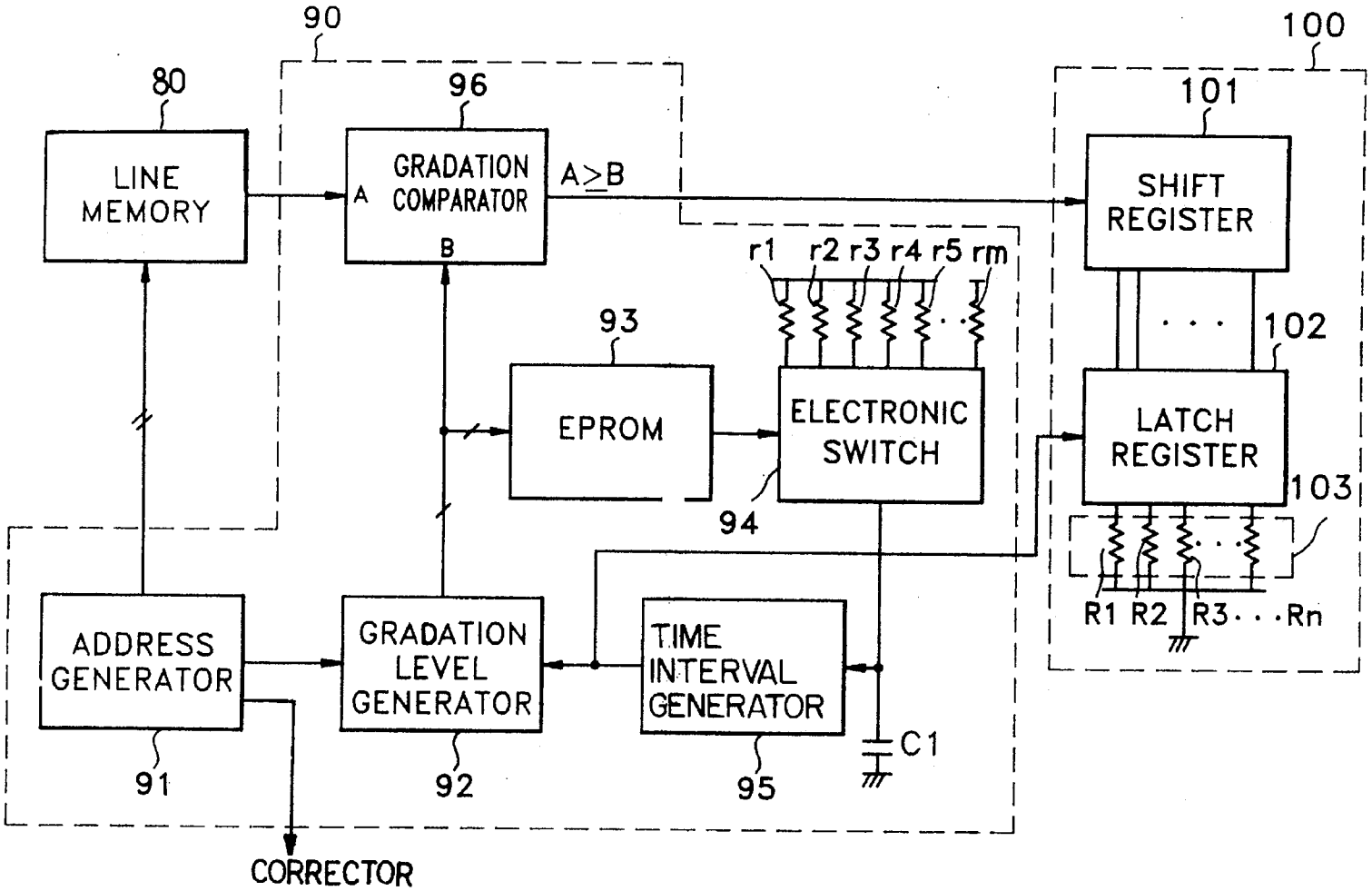
FIG. 2 is a detailed circuit diagram of a middle gradation converter shown in FIG. 1.
Figure 4:
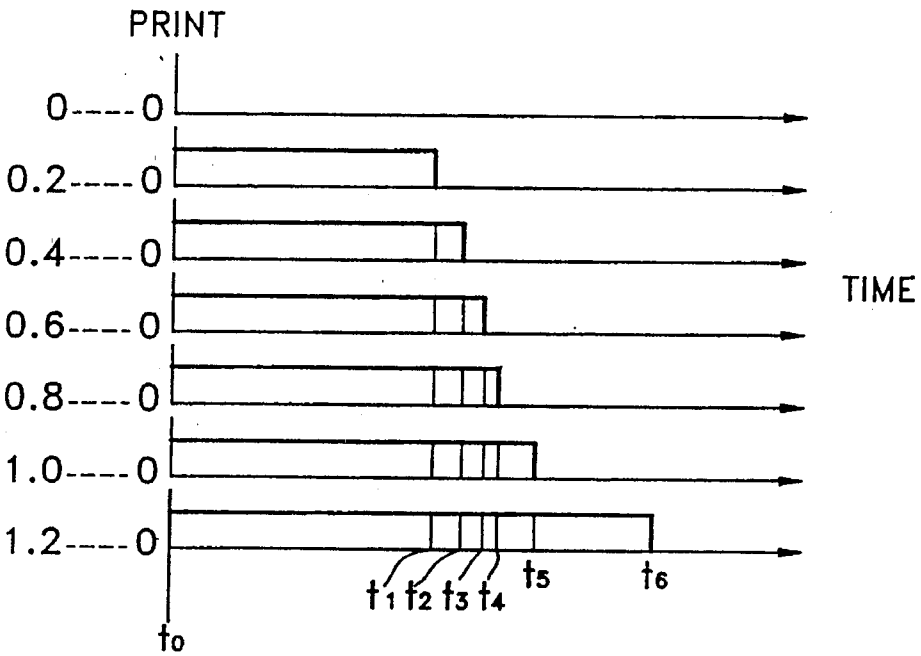
FIG. 4 is a graph which depicts the relation between the heating time of the thermal print head shown in FIG. 1 and print density.
Figure 3:
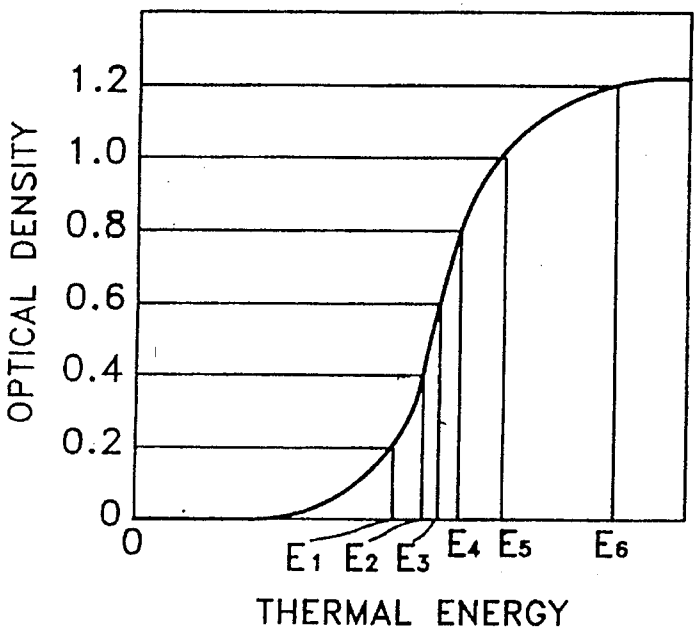
FIG. 3 is a graph which depicts the sensitivity curve of the print film.
Figure 5:
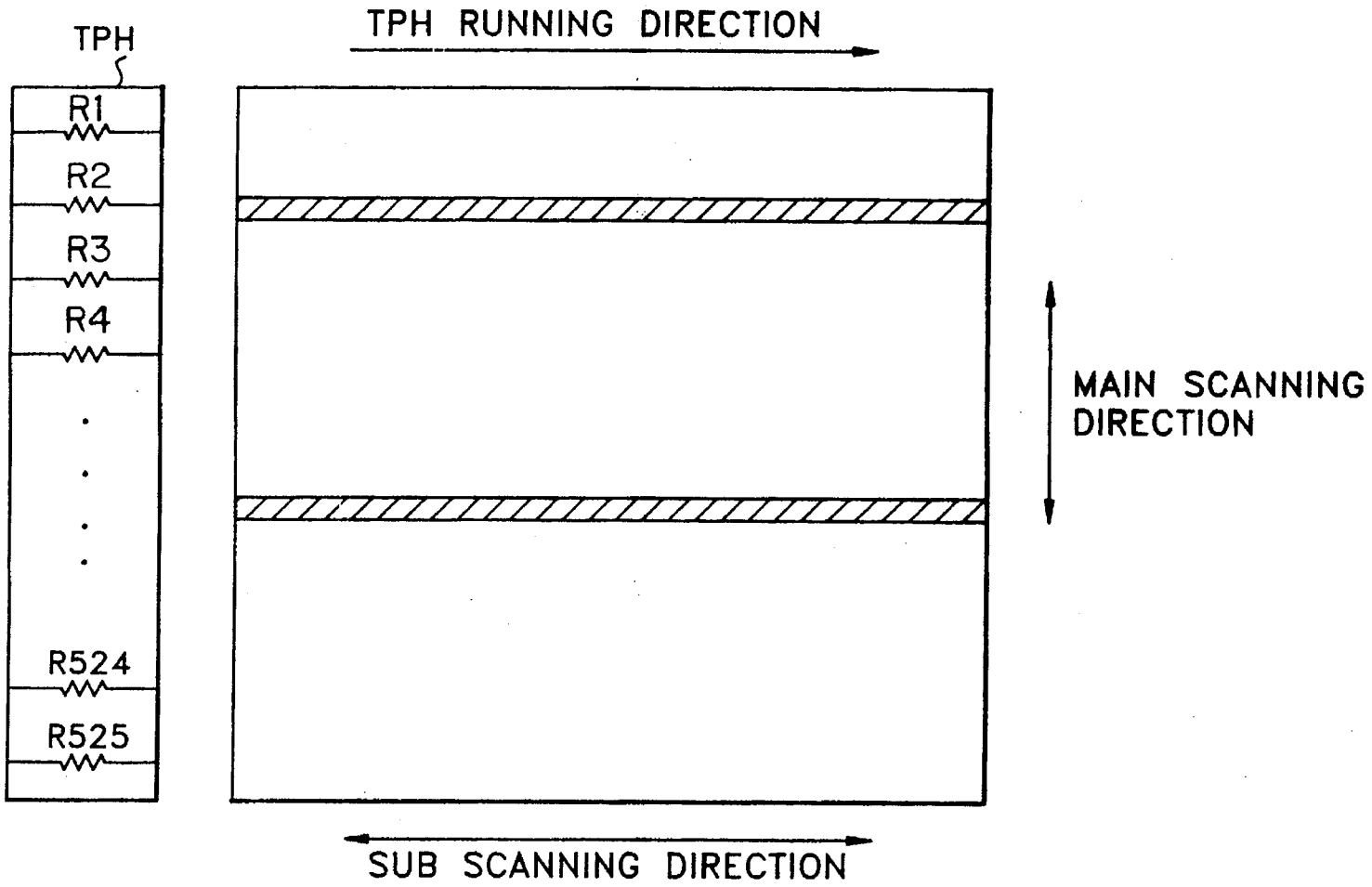
FIG. 5 is a diagram which portrays the screen printed by the thermal print head shown in FIG. 1.
Figure 6:
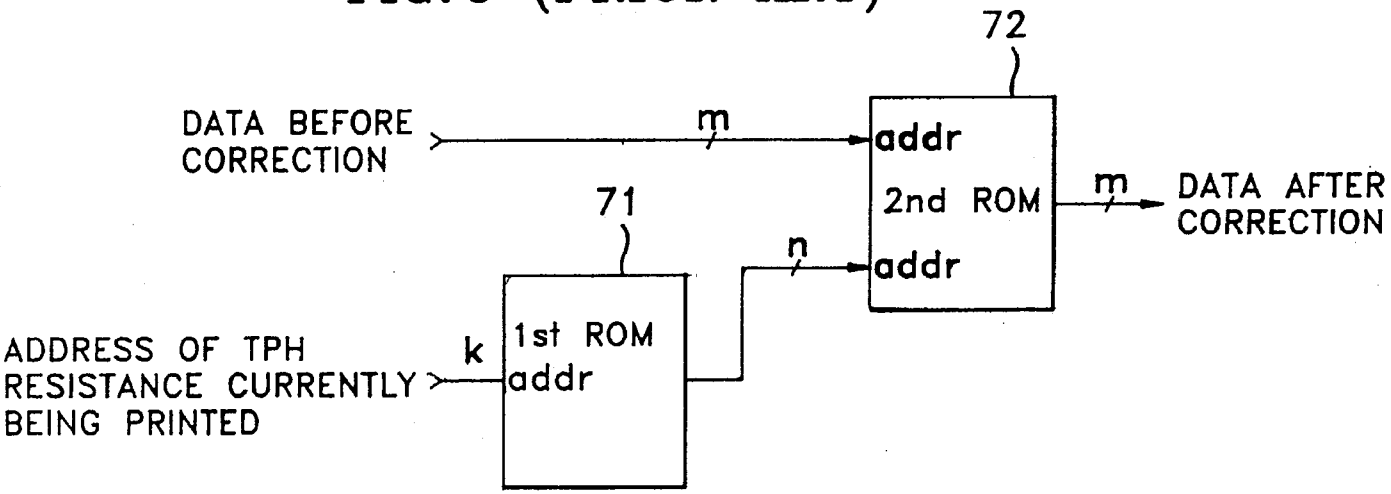
FIG. 6 (PRIOR ART)
FIG. 6 is a block diagram of a conventional corrector in the thermal printer shown in FIG. 1.

A thermal printer to which the correction apparatus according to the present invention is applied has the same construction as that of the thermal printer shown in FIGS. 1 and 2.

Figure 7:
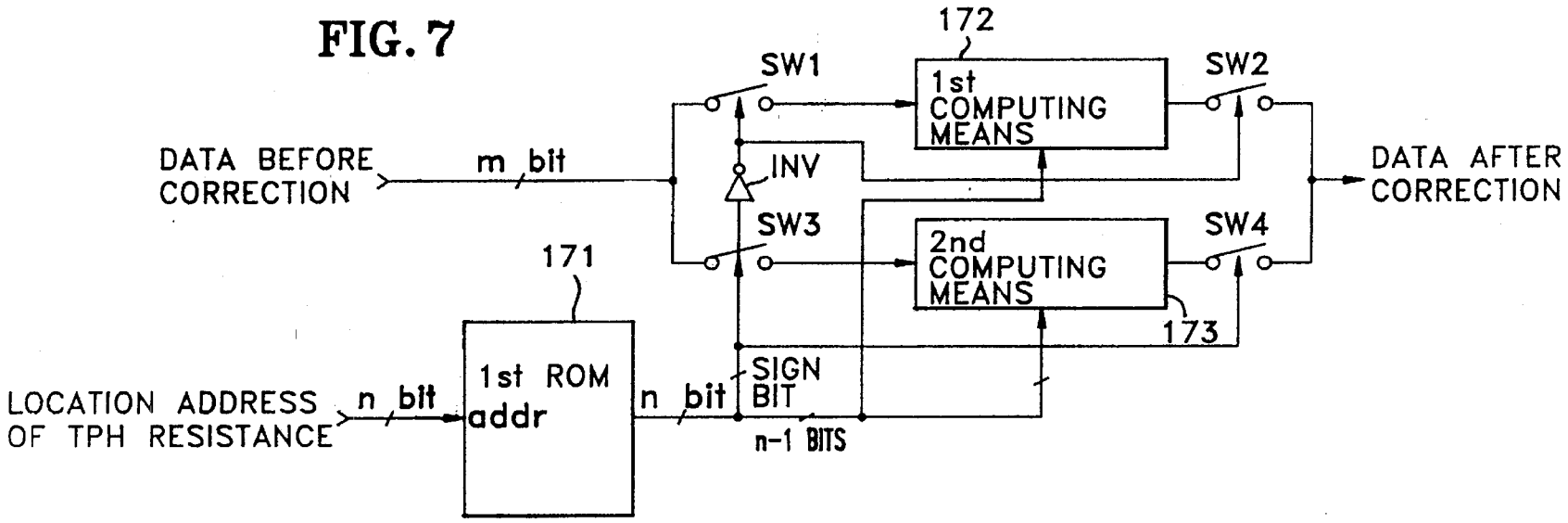
FIG. 7 is a circuit diagram of a corrector for a thermal printer according to an embodiment of the present invention.

FIG. 7 is a circuit diagram of an embodiment of a correction apparatus for a thermal printer according to the present invention.

Referring to FIG. 7, an input terminal of a first ROM 171 is connected to the output terminal of address generator 91 of middle gradation converter 90 shown in FIG. 2. The output terminal of first ROM 171 is connected to the control contact points of third and fourth control switches SW3 and SW4 and to second input terminals of first computing means 172 and second computing means 173.

Input terminals of first and third control switches SW1 and SW3 are connected to the output of color converter 60 shown in FIG. 1, and the output terminals thereof are connected to first input terminals of first computing means 172 and second computing means 173, respectively. Input terminals of second and fourth control switches SW2 and SW4 are connected to the output terminals of first computing means 172 and second computing means 173, respectively, while their output terminals are connected to the input of line memory 80 shown in FIG. 1. The input of inverter INV1 is connected to the output terminal of ROM 171, and the output thereof is connected to both control contact points of first and second control switches SW1 and SW2.

Operation of the correction apparatus shown in FIG. 7 is explained as follows.

When the resistance location address currently being printed is input to an input terminal ADDR of first ROM 171, a coefficient is output which corresponds to the amount of deviation of the resistance associated with the resistance location address.

The coefficient is stored in first ROM 171 in binary form and is expressed by (n−1)-bits, with the most significant bit being a sign bit.

First through fourth control switches SW1 to SW4 are selectively operated depending on the most significant bit (sign bit) among the n-bit data output from ROM 171.

When the sign bit is "high," which means that the corresponding resistance value designated by the resistance location address is higher than the average resistance value, third and fourth control switches SW3 and SW4 are closed. When the sign bit is "low," which means that the corresponding resistance value designated by the resistance location address is lower than the average resistance value, first and second control switches SW1 and SW2 are closed via inverter INV1.

When first and second control switches SW1 and SW2 are closed, the uncorrected image data is input to a first input terminal of first computing means 172 from color converter 60. First computing means 172 adds (n−1)-bit coefficient data for the gradation increase according to the deviation of the relevant resistance output from ROM 171 to the uncorrected image data. As a result, the m-bit compensative data is output.

First computing means 172 is explained in more detail as follows.

For convenience, assume that the image data before the compensation is "i", and (n−1)-bit coefficient output from first ROM 171 is k. Output Q of first computing means 172 can be expressed as follows.

$$Q=i+ik \quad (1)$$

That is, image data (i) before the compensation and coefficient (k) is multiplied in first computing means 172. The result (ik) is added to image data (i) before the compensation and is output. When, as a result of the computation, a carry is generated in the (m+1)-bit of the output of first computing means 172, each of the m-bit outputs (Q) output to second control switch SW2 is "1".

Accordingly, output Q assumes $2^m$ as its value. For example, if m is 8-bits, the value of Q cannot exceed 255 expressed in decimal form.

When third and fourth control switches SW3 and SW4 are closed, the uncorrected image data is input to a first input terminal of second computing means 173 from color converter 60. Second computing means 173 subtracts (n−1)-bit data for the gradation decrease according to the deviation of the relevant resistance output from ROM 171, from the uncorrected image data, thereby outputting the compensated data.

Second computing means 173 is explained in more detail as follows.

Output Q' of second computing means 173 can be expressed as follows.

$$Q'=i-ik \quad (2)$$

That is, image data (i) before the compensation and coefficient (k) is multiplied in second computing means 173. The result (ik) is subtracted from image data (i) before the compensation and is output.

When, as a result of the computation, a borrow is generated in the (M+1)-bit of the output of second computing means 173, each of the m-bit outputs (Q') output to fourth control switch SW4 is "0".

Accordingly, output Q of first computing means 172 and output Q' of second computing means 173 are the values wherein the gradation value of the image data commonly expressed by 256 gradations incorporates the amount of deviation of each resistance. The outputs of first and second computing means 172 and 173, i.e., the image data which is actually printed, is compensated in accordance with the amount of deviation of the heating element resistance and with the gradation value.

Figure 8:
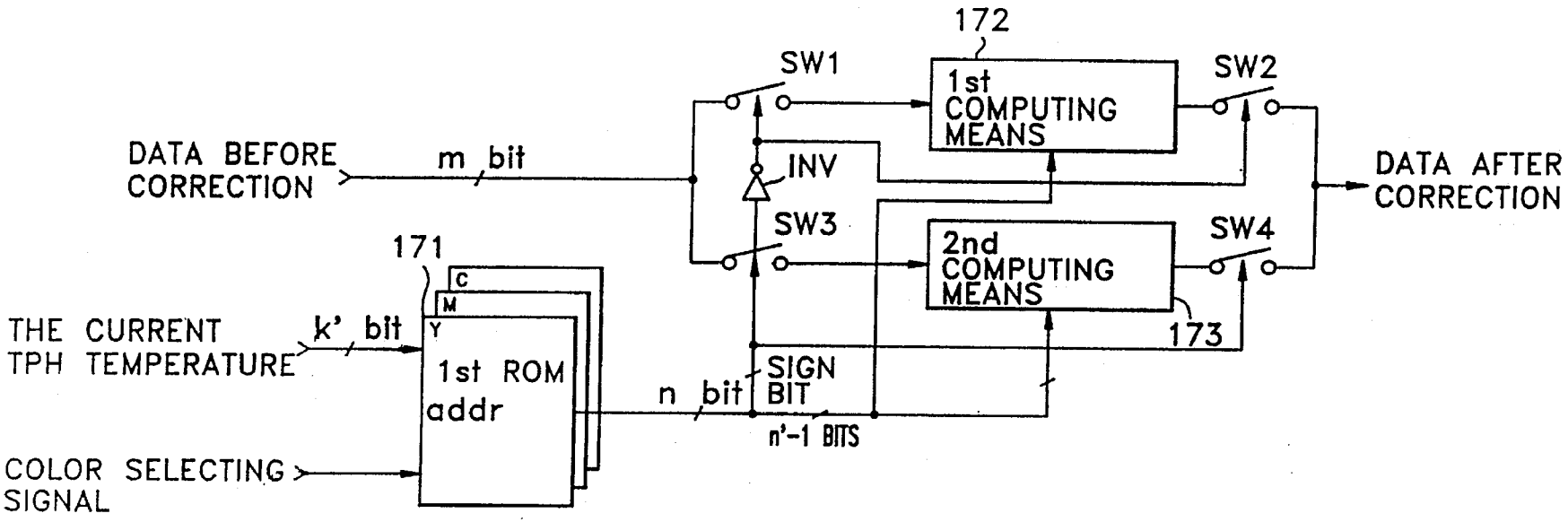
FIG. 8 is a circuit diagram of a corrector for a thermal printer according to another embodiment of the present invention.

Here, not only the compensation value according to the resistance deviation but also the temperature and color-correction data obtained through experiment can be stored in ROM 171, as shown in FIG. 8. For example, a coefficient of correction data in accordance with the current TPH temperature can be stored in first ROM 171 for each of colors Y, M and C. The means (not shown) for detecting the current TPH temperature is a thermistor or the like, which is commonly known.

Correction data is stored in first ROM 171, so that when the current TPH temperature is higher than the predetermined reference temperature, the gradation value of the image data output from line memory 80 can be lowered. Correction data for increasing the gradation of the image data output from line memory 80 when the current TPH temperature is lower than the reference temperature is also stored.

Here, one bit, i.e., the most significant bit of the correction data, is used as a sign bit. When the most significant bit is "1," the current TPH temperature is higher than the predetermined reference temperature, and when the most significant bit is "0," the current TPH temperature is lower than the predetermined reference temperature.

In first ROM 171, the correction data for varying the image data value stored in the line memory according to the difference of the temperature of the current thermal print head and the reference temperature is stored in a look-up table for yellow, magenta and cyan colors.

As described above, the correction apparatus of the thermal printer of the present invention corrects for resistance deviation of a heating element, and performs temperature and color corrections using a simple circuit, to thereby reduce the memory capacity and hardware volume.

What is claimed is:

1. A thermal printer which introduces an image signal from a signal input source and performs a gradation comparison with respect to a predetermined gradation value by line units, and then performs printing using a thermal print head consisting of a plurality of heating elements, said printer comprising:

a line memory for storing said image signal as image data by line units;

correction means having a memory and a computing means, said memory for storing deviation information of each heating element of said thermal print head, and said computing means for adding the image data of said line memory to an amount of deviation, wherein a gradation value of said image data is reflected, by reading the deviation information stored in said memory when a resistance value of one of said heating elements for printing image data read from said line memory has a lower than an average resistance value, and for subtracting an amount of deviation, wherein a gradation value of said image data is reflected, from the image data of said line memory by reading the deviation information stored in said memory when said resistance value of one of said heating elements for printing image data read from said line memory is higher than an average resistance value; and TPH control means for performing a gradation comparison between an output of said correction means and said predetermined gradation value, and outputting a result to said thermal print head;

wherein said computing means comprises:

a first computing means having first and second input terminals and an output terminal, wherein said first input terminal is connected to the output terminal of said memory;

a second computing means having first and second input terminals and an output terminal, wherein said first input terminal is connected to the output terminal of said memory;

a first control switch for receiving uncompensated data and having an input terminal for inputting an image data, a fixed contact point connected to said second input terminal of said first computing means, and a control point connected to the output terminal of said memory;

a second control switch for outputting compensated data and having an input terminal connected to the output terminal of said first computing means, and a control point connected to the output terminal of said memory;

a third control switch for receiving uncompensated data and having an input terminal for inputting an image data, a fixed contact point connected to said second input terminal of said second computing means, and a control point connected to the output terminal of said memory; and a fourth control switch for outputting compensated data and having an input terminal connected to the output terminal of said second computing means, and a control point connected to the output terminal of said memory.

2. A correction apparatus for the thermal printer according to claim 1, wherein the control points of said first to fourth control switches are each connected to the most significant bit terminal of said memory.

3. A correction apparatus for the thermal printer according to claim 2, wherein the most significant bit of said memory is a sign bit indicative of a comparison between a resistance value corresponding to introduced image data and an average resistance value.

* * * * *